United States Patent [19]

Kingsley et al.

[11] 4,129,779

[45] Dec. 12, 1978

[54] PHOTOCONTROLLED ION-FLOW ELECTRON RADIOGRAPHY APPARATUS WITH MULTI-LAYERED MESH STRUCTURE

[75] Inventors: Jack D. Kingsley; Kei-Hsiung Yang, both of Schenectady, N.Y.

[73] Assignee: General Electric Company, Schenectady, N.Y.

[21] Appl. No.: 834,649

[22] Filed: Sep. 19, 1977

[51] Int. Cl.[2] ..... G03D 41/16

[52] U.S. Cl. ..... 250/315 A

[58] Field of Search ..... 250/315 R, 315 A

[56] References Cited

U.S. PATENT DOCUMENTS

| | | | |
|---|---|---|---|
| 3,603,790 | 9/1971 | Cleare | 250/315 A |
| 3,940,620 | 2/1976 | Houston | 250/315 A |
| 4,039,830 | 8/1977 | Yang | 250/315 A |
| 4,064,439 | 12/1977 | Yang | 250/315 A |

*Primary Examiner*—Craig E. Church

*Attorney, Agent, or Firm*—Geoffrey H. Krauss; Joseph T. Cohen; Marvin Snyder

[57] ABSTRACT

Photocontrolled ion-flow electron radiography apparatus has a multi-layered mesh structure, comprised of a conductive apertured sheet supporting an insulating layer, overlayed with a conductive screen and a topmost layer of photoconductive material, to control an ion stream responsive to a charge image formed in the photoconductive layer responsive to a pattern of x-rays differentially-absorbed by an object to be analyzed.

25 Claims, 4 Drawing Figures

PHOTOCONTROLLED ION-FLOW ELECTRON RADIOGRAPHY APPARATUS WITH MULTI-LAYERED MESH STRUCTURE

BACKGROUND OF THE INVENTION

The present invention relates to photocontrolled ion-flow electron radiography apparatus for x-ray imaging and, more particularly, to novel ion-flow electron radiographic apparatus having a multi-layered mesh structure of reduced mechanical complexity Xeroradiographic imaging techniques, wherein x-radiation differentially absorbed in an object causes the deposition of an electrostatic image on an insulative sheet, for subsequent development by xerographic techniques, is known for replacement of conventional x-ray imaging techniques using the screen-film system. Pending U.S. patent application Ser. No. 716,088, filed Aug. 20, 1976 and assigned to the assignee of the present invention, discloses and claims methods and apparatus for x-ray imaging by photocontrolled ion flow electron radiography. The apparatus in the afore-mentioned pending patent application, incorporated herein by reference, comprises an electron structure of a conductive sheet receiving the differentially-absorbed x-radiation and supporting a plastic sheet forming one boundary of an air gap. A second electrode comprises a conductive mesh supporting, of a surface thereof facing the plastic sheet, a layer of photoconductive material which is precharged prior to x-ray exposure. A phosphor plaque is moved into abutment with the pre-charged photoconductive layer during x-ray exposure and acts to convert x-ray quanta to photons of visible light for rendering underlying portions of the photoconductive layer to the conductive condition and removing charge therefrom to the conductive screen. After exposure, a source provides a stream of ions of the same polarity as that utilized for precharging the photoconductive layer, for movement through the photoconductive mesh toward the plastic sheet. The ion flow is modulated by the electric charge pattern stored at the photoconductive layer to deposit a charge pattern on the plastic sheet, for subsequent development by xerographic techniques. As the phosphor plaque must be moved into engagement with the photoconductive layer during x-ray exposure, and must be removed from the gap to allow the controlled ion flow to reach the plastic sheet, considerable mechanical complexity results. It is desirable to gain the advantage of photocontrolled ion-flow electron radiography (i.e. high device gain, with reduced x-ray dosage to a patient) while reducing the mechanical complexity of the recording device.

BRIEF SUMMARY OF THE INVENTION

In accordance with the invention, apparatus for photocontrolled ion-flow electron radiography utilizes a first solid electrode having a conductive layer upon which differentially-absorbed x-rays, from an object to be analyzed, impinge and are transmitted therethrough to a multi-layer mesh structure comprised sequentially of a layer of a photoconductive material, nearest the first electrode; a thin transparent conductive film; a layer of a phosphor material characterized by the ability to convert x-ray quanta to photons of light in the ultraviolet or visible spectral regions; and a conductive mesh having the mesh apertures thereof aligned with apertures through the overlying layers of phosphor, conductive film and photoconductor. Incident differentially-absorbed x-radiation is converted in the phosphor layer to light photons transmitted through the thin transparent conductive film for differentially discharging portions of the photoconductive insulating layer, previously imparted with a charge by means of a corona discharge device and the like; a charging image of the object to be analyzed is thus generated upon the photoconductive layer. A stream of ions, of like polarity to the polarity of the charges initially deposited at the photoconductive layer, are projected through each aperture of the multi-layered mesh structure and are modulated by the adjacent net charge of the charge image, whereby a stream of ions is differentially transmitted, in inverse proportion to the per-unit-area magnitude of the charge image at the photoconductive layer, to an insulating film positioned upon a surface of the face first electrode facing the mesh structure. A potential source is coupled between the first electrode conductive layer and the thin conducting film of the mesh structure for forming an electric field in the electrode-screen gap for accelerating the ions to the film, whereby the magnitude of the charge deposited per unit area on the film is controlled by the magnitude of ion flux and the ion pattern may be deposited on the insulative film with high gain, limited only by the dark decay time of the photoconductive material, with the charge image being subsequently developed by known xerographic techniques to provide a permanent radiograph.

Accordingly, it is one object of the present invention to provide novel apparatus having a multi-layered mesh structure for accomplishing photocontrolled ion-flow radiography.

It is another object of the present invention to provide novel ion-flow radiographic apparatus of reduced mechanical complexity.

These and other objects of the present invention will become apparent upon consideration of the following detailed description and the accompanying drawings.

DETAILED DESCRIPTION OF THE INVENTION

Figure 1:
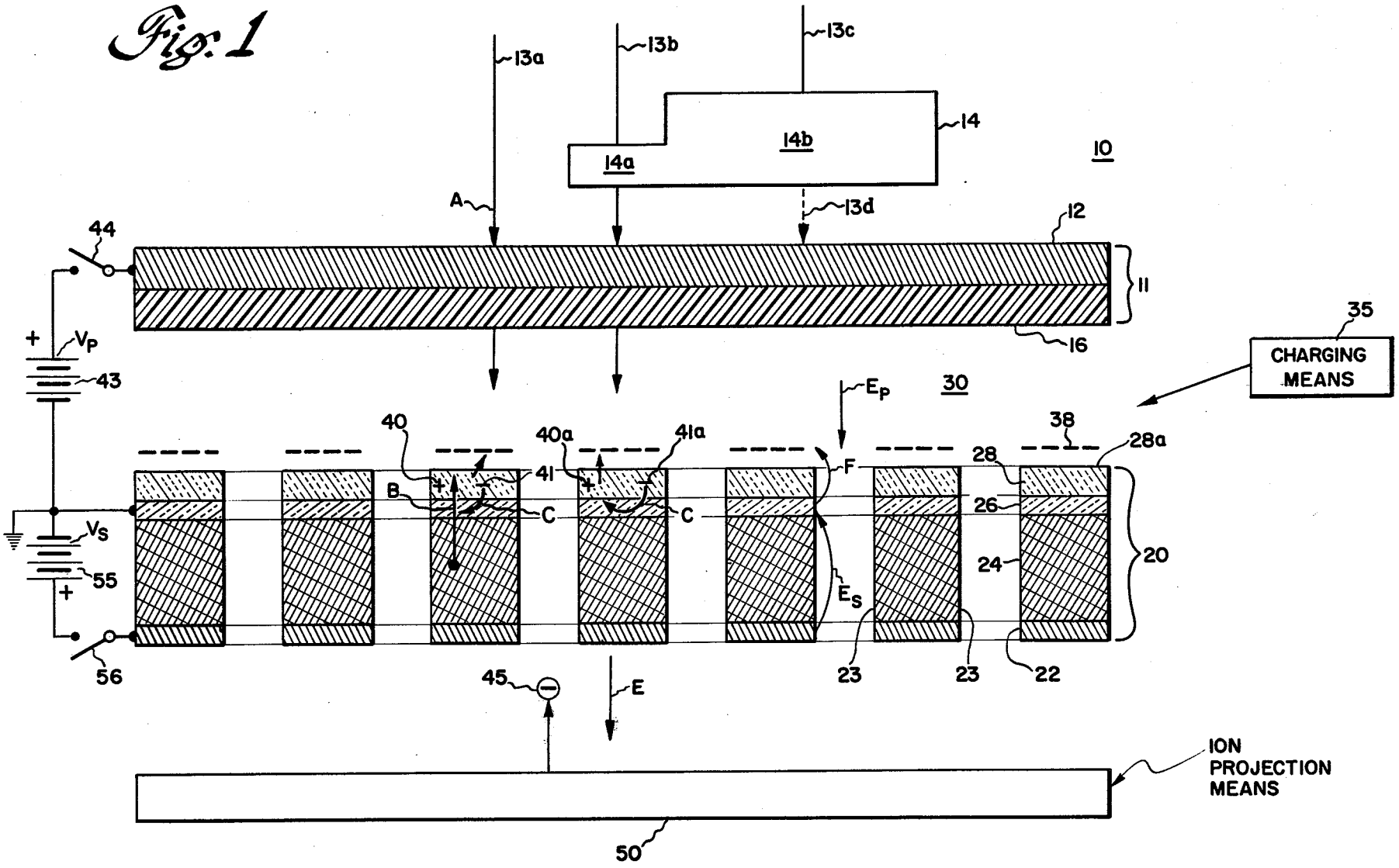
FIG. 1 is a sectional side view of apparatus in accordance with the principles of the present invention, and illustrating the operation thereof in obtaining a permanent radiograph.

Referring now to FIG. 1, wherein elements are not drawn to scale, apparatus 10 for photocontrolled ion-flow radiography comprises a first electrode 11 including a substantially planar conductive sheet 12, preferably formed of a light metal, such as aluminum and the like, transparent to x-radiation 13 directed from an x-ray source (not shown) and passing through portions of an object 14 to be analyzed. Thus, x-ray quanta 13*a* pass outside object 14 do not undergo absorption or attenuation prior to passage, in the direction of arrow A, through electrode 11; x-ray quanta 13*b* pass through a relatively thin portion 14*a* of the object and are somewhat attenutated in accordance with the density and depth of the object portion traversed; and x-ray quanta 13c pass through another portion 14b object assumed of density and path length sufficient to completely absorb quanta 13c, whereby substantially none of x-ray quanta 13c, as indicated by the phantom line path portion 13d, impinge upon first electrode 11. Conductive sheet 12 supports a film 16 of an insulating material such as polyester film and the like, upon the sheet surface furthest from the incident x-radiation, and in such manner as to allow film 16 to be easily removed from sheet 12.

A second electrode 20 is spaced from the insulative-film-bearing surface of first electrode 11, and includes a mesh substrate 22, of a conductive, preferably metallic, material. The conductive mesh has a two-dimensional array of microscopic apertures 23 formed therethrough. A layer 24 of phosphor material, characterized by conversion of x-ray quanta to photons of light in the ultraviolet and/or visible spectrum, is fabricated essentially only upon the solid portions of mesh screen 22. A thin film 26 of a conductive substance which is transparent to the optical photons emitted by phosphor 24, is fabricated only upon the surface of the phosphor layer opposite mesh 22. A layer 28 of a photoconductive insulating material is fabricated essentially only upon the solid portions of the underlying thin, conductive and transparent film 26. Thus, a multi-layered mesh electrode structure 20 is fabricated wherein each of the microscopic apertures 23 extends in registration through all of the multiplicity of layers and in a direction essentially perpendicular to the surfaces of the mesh electrode. Mesh structure 20 is positioned such that the photoconductive layer 28 is closest to, substantially parallel to, and spaced from first electrode 11, to create a gap 30 between the facing interior surfaces of the mesh structure and the first electrode.

A suitable metallic mesh substrate 22 may have a thickness from about 3 microns to about 25 microns and that a suitable phosphor layer 24, such as cesium iodide doped with sodium, has a thickness from about 50 microns to about 250 microns. A suitably optically-transparent conducting layer 26 may be formed of materials such as tin oxide, indium oxide and the like, with a thickness from about 100 Angstroms to about 5000 Angstroms in thickness, when used with photoconductive insulating layer formed of amorphous selenium, of thickness ranging from about 10 microns to about 100 microns.

In operation, prior to x-ray exposure, the surface of photoconductive insulating layer 28 is charged in darkness, by means of either a positive or a negative corona from charging means 35. Illustratively, charging means 35 supplies a negative corona, whereby a multiplicity of negative charges 38 are deposited substantially uniformly adjacent the top surface 28a of the photoconductive layer. Object 14 is now exposed to x-ray quanta 13 and the differentially-absorbed x-rays pass through first electrode 11 to be principally absorbed in phosphor layer 24 and photoconductive layer 28. Those of the differentially-absorbed x-ray photons absorbed in phosphor layer 24 cause the emission of optical photons in the ultraviolet or visible spectral regions, with a portion of these optical photons being transmitted through transparent layer 26, as shown by arrow B, for absorption in the photoconductive layer. A portion of the optical photons transmitted through transparent conductive layer 26 are absorbed in photoconductive layer 28 to create pairs of holes 40 and electrons 41. Electrons 41 are conducted away from the photoconductive layer through conductive layer 26, as shown by arrow C, to ground potential, while holes 40 drift to the surface of the photoconductive layer and there neutralize a corresponding number of negative ions 38 present at the layer surface, with a neutralization magnitude proportional to the intensity of x-rays impingent upon the portion of phoshor layer 24 adjacent to the portion the photoconductive layer bearing the negative ions undergoing neutralization. X-ray photons directly absorbed in the photoconductive layer also create electron-hole paris with the electrons 41a undergoing conduction, in the direction of arrow C, to conductive film 26 and ground potential, and with the holes 40a drifting to the photoconductive layer surface 28a for neutralization of additional negative ions 38. Thus, after x-ray exposure, the charge pattern on the photoconductor surface resembles the x-ray image, in that the essentially unattenuated x-rays 13a have produced a relatively large number of electron-hole pairs resulting in neutralization of many negative ions 38, while the attenuated stream of x-ray photons 13b, passing through object portion 14a, produce relatively fewer electron-hole pairs and cause a greater number of negative ions 38 to be present adjacent the photoconductive surface 28a; and the total absorption of x-ray photons 13c, in object portion 14b, substantially prevents generation of electron-hole pairs in the portions of photoconductive layer 28 thereunder, whereby essentially all of the negative ions 38 remain at photoconductive layer 28a of those portions.

The charge image at the surface of the photoconductive layer is now transferred to insulating sheet 16. A first source 43 of electrical potential, of magnitude $V_p$, is coupled, by closure of a switch means 44, between first electrode conductive sheet 12 and conductive film 26 of the mesh structure. The polarity of potential source 40 is established to provide a primary electric field $E_p$, in the direction of arrow $E_p$, to accelerate ions 45 (of the same polarity as the ions 38 previously deposited at the photoconductive layer) toward first electrode 1. A stream of ions 45, e.g. of negative polarity identical to the negative polarity of ions 38 deposited at the photoelectric layer, is projected from beyond the mesh 22 of mesh structure 20, by ion projection means 50. The ions 45 of the stream pass through mesh structure apertures 23 and are accelerated across gap 30, by interaction with primary electric field $E_p$, toward plastic sheet 16. The substantially uniform distribution of projected ions 45 arising at mesh structure 20 is modulated, by like-charge-repulsion effects, by the charge image at photoconductive layer 28. Thus, those portions of the photoconductive layer, as beneath relatively thick object portion 14b, having the greatest negative charge-per-unit area, tend to generate a fringing field F, in the direction of arrow F, of magnitude sufficient to cause ions 45 to be either fully repelled or to impinge upon conductive film 26, for conduction away from gap 30. Thus, relatively few of ions 45 pass through apertures 23 associated with the "islands" of relatively high negative charge 38 and accordingly relatively little charge is deposited on the associated overlying areas of film 16. Similarly, electrons 45 encounter fringing fields of relatively less magnitude in those of apertues 23 associated with "islands" of relatively lower numbers of negative ions 38, such as underlying thin object portion 14a, whereby relatively greater numbers of projected ions pass through these apertures and are accelerated across gap 30 for deposition upon associated areas of the film 16. Those areas of photoconductive layer 28 having relatively small amounts of negative ions 38, due to receipt of the substantially unattenuated x-ray photons 13a, generate very small, or zero, magnitudes of fringing field, whereby relatively large numbers of projected ions 45 pass through the associated apertures 23 and are deposited upon the associated plastic sheet portions. Thus, a charge image is deposited upon the plastic sheet having areas of high charge density associated with areas of minimum x-ray absorption by the object. Sheet 16 is now removed and developed by known xerographic techniques.

A relatively large current of projected ions 45 is controlled by a relatively smaller distribution of ions 38, whereby relatively low intensity x-radiation exposure of the object to be analyzed is sufficient to control a relatively large projected ion current and provide a radiograph of high contrast. The contrast is adjustble by means of another potential source 55, of magnitude $V_s$, connected, by closure of switch means 56, with polarity such as to cause conductive mesh 22 to be positive with respect to conductive film 26, whereby a fringing field of magnitude $E_s$ is present in each of apertures 23. As the direction of the fringing field, indicated by the direction of arrow $E_s$, is such as to oppose movement of projected ions 45 through apertures 23, variations in the voltage $V_s$ cause variations in the projected ion current. Thus, increasing the magnitude of the secondary potential $V_s$ causes a greater field to be generated in each of the apertures of the entire aperture array and uniformly reduces the projected ion current so as to uniformly reduce the intensity of the entire charge image deposited on sheet 16, while a decrease in the magnitude of the secondary voltage (or a reversal in the polarity of $V_s$ source 55) provides a decreased secondary field (or a secondary field of reversed direction) facilitating increased projected ion current and increased charge image deposition on the plastic sheet, resulting in an image of greater contrast.

Figure 2A:
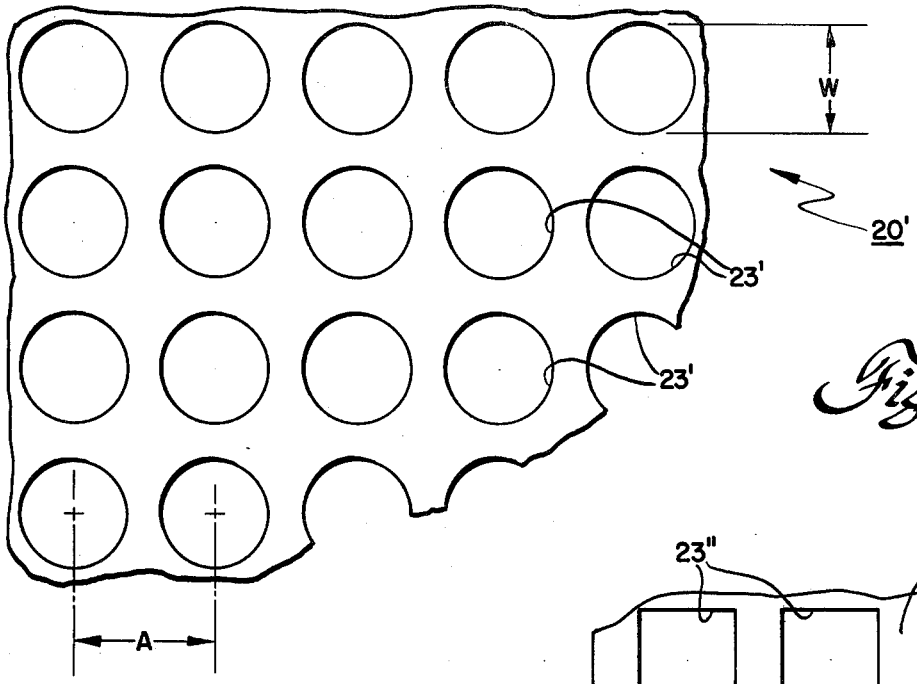
FIGS. 2*a* and 2*b* are partial plan views of two presently preferred embodiments of apertured multi-layer mesh structures in accordance with the invention.
Figure 2B:
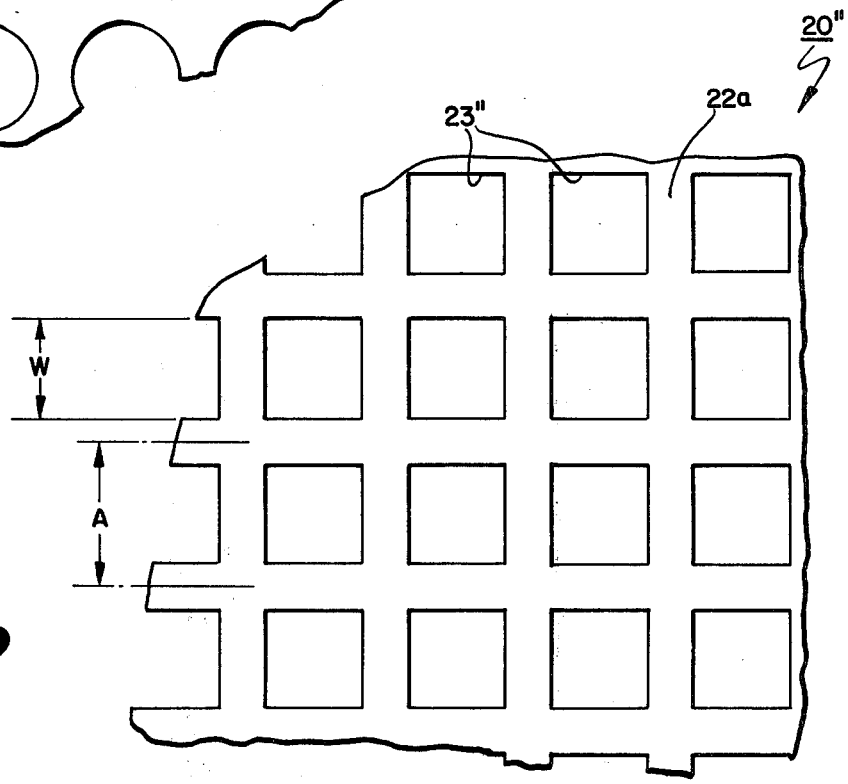

Referring now to FIGS. 2a and 2b, plan views of presently preferred mesh structures 20' and 20'' are illustrated. The first mesh structure 20' (FIG. 2a) includes a two-dimensional array of cylindrical apertures 23', advantageously formed by fabricating the composite mesh 20' of four continuous layers (metal substrate 22, phosphor layer 24, transparent conducting film 26 and photoconductive layer 28) sequentially of flat continuous sheets of the various materials and then forming the cylindrical apertures therethrough by laser drilling and the like techniques. In our presently preferred embodiment, each cylindrical aperture has an average hole diameter W from about 40 microns to about 160 microns, with the average center-to-center spacing A coordinately varying from about 50 microns to about 200 microns, whereby the ratio of aperture diameter to aperture spacing is between about 0.4 and about 0.9.

The mesh structure embodiment 20'' (FIG. 2b) is fabricated upon a flat metallic mesh screen having substantially square apertures 23'' as formed by two multiplicities of strands disposed substantially perpendicular with each other and in abutment. The phosphor layer, typical of cesium iodide doped with sodium, is deposited upon the solid portion 22a of the mesh by hot-wall evaporation or vacuum evaporation (with the metal mesh being heated to a temperature between 200° C and 400° C during the evaporative stage); the transparent conducting film is fabricated of material such as tin oxide, indium oxide, tungsten, aluminum and the like, by processes such as spray coating, vacuum evaporation, sputtering and the like; and the photoconductive layer is then fabricated by similar processes, upon the transparent conducting film, of material such as amorphous selenium, polyvinyl carbazole, zinc oxide, cadmium sulphide and the like. The substantially square apertures 23'' have side dimensions W and the solid mesh portions 22a have spacing dimensions A similar to the diameter and center-to-center spacing dimensions and ratio of the embodiment of FIG. 2a.

Figure 3:
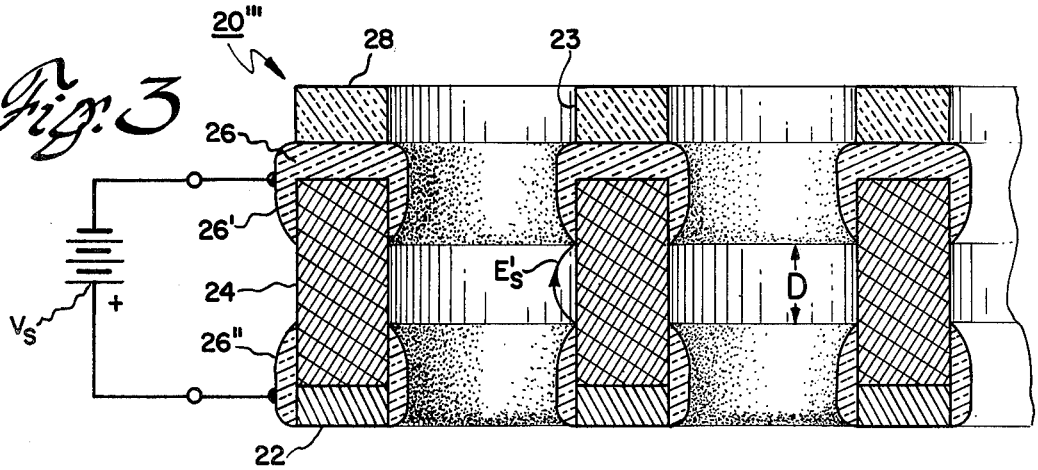
FIG. 3 is a partial, sectional view of another presently preferred multi-layered mesh structure in accordance with the invention.

Referring now to FIG. 3, we have found that if the phosphor layer 24 of the composite is thicker than about 50 microns, the negative ions (projected from a corona source and accelerated by propulsion field $E_p$) may accumulate on the sides of the phoshor layer 24 within the apertures of the composite mesh, during the ion-projection process. The accumulation of charge will eventually interrupt the ion flow through apertures 23 and introduce defects in the charge image deposited at layer 16. We have found that this ion accumulation effect is prevented by fabricating the conducting transparent film to have integral portions 26' extending over a portion of the surface of phosphor layer 24 adjacent film 26 and within each aperture, and by fabricating additional portions 26'' extending over other portions of the aperture-defining surface of phosphor layer 24 at the end thereof furthest from films 26 and adjacent conductive mesh 22; a gap distance of about 50 microns remains between the nearest ends of conductive film portions 26' and 26''. The bias voltage $V_s$ now generates the variable current-controlling field $E'_s$ between the nearest ends of conductive portions 26' and 26'', which fringing field is relatively strong and prevents any of the projected ions from being deposited upon the aperture-forming sides of the phosphor layer.

While several presently preferred embodiments of the invention have been described herein, many other variations and modifications will now become apparent to those skilled in the art. Thus, the photoconductive layer may be initially charged with positive charges, with the neutralization thereof be effected by the electrons of the electron-hole pairs, and with positive ions being projected by means 50 (with suitable changes in the polarity of at least source 43, to reverse the directon of field $E_p$, for accelerating the positive ions). Similarly, the phosphor material may be selected from thulium-doped lanthanum oxybromide; silver doped zinc-cadmium sulphide (ZnCd) S:Ag; calcium tungstate $CaWO_4$; terbium-doped gadolinium oxysulfide $Gd_2O_2S$:Tb; barium fluorochloride BaFCl; terbium-doped lanthanum oxybromide LaOBr:Tb; hafnium phosphate $HfP_2O_7$ and the like. It is our intent, therefore, to be limited only by the scope of the appending claims and not by the scope of the few specific embodiments herein described.

What is claimed is:

1. Apparatus for use in the radiographic analysis of an object differentially absorbing x-ray quanta, comprising:

a first electrode supporting a sheet of insulating material;

a control mesh structure spaced from said first electrode to form a gap therebetween, said control mesh structure including, disposed sequentially away from said first electrode, a layer of a photoconductive insulating material; a thin film of a transparent and conductive material; a layer of material for conversion of x-ray quanta to photons in the ultraviolet and visible spctral regions; and a conductive mesh screen; said mesh control structure having a two-dimensional array of apertures formed therethrough;

means for depositing a quantity of a first polarity of electrical charge substantially uniformly adjacent a surface of said photoconductive layer facing said gap;

means for emitting a stream of ions of said first polarity toward said mesh electrode of said control mesh structure; and means for applying an electric field across the gap for accelerating said ions toward said insulating layer of said first electrode; said ions being transmitted through the apertures of said mesh control structure and modulated by the charge remaining in areas of said photoconductive layer adjacent to each aperture after impingement of the differentially-absorbed x-rays, to create a charge image of said object upon said insulating sheet.

2. The apparatus as set forth in claim 1, wherein said photoconductive material is selected from the group consisting of amorphous selenium, polyvinyl carbazole, zinc oxide and cadmium sulphide.

3. The apparatus as set forth in claim 1, wherein said conductive transparent material is selected from the group consisting of tin oxide, indium oxide, tungsten and aluminum.

4. The apparatus as set forth in claim 1, wherein said material for converting x-ray quanta to optical photons is selected from the group consisting of: CsI:Na; LaOBr:Tm; LaOBr:Tb; (ZnCd)S:Ag; $CaWO_4$; $Gd_2O_2S$:Tb; BaFCl and $HfP_2O_7$.

5. The apparatus as set forth in claim 1, wherein each of the apertures in said two-dimensional array is of circular cross-section.

6. The apparatus as set forth in claim 5, wherein said apertures have a diameter of between about 40 microns and about 160 microns.

7. The apparatus as set forth in claim 5, wherein the average center-to-center spacing of said apertures is from about 50 microns to about 200 microns; the ratio of said diameter to said spacing being from about 0.4 to about 0.9.

8. Apparatus as set forth in claim 1, wherein said each of the apertures in said two-dimensional array is of substantially square cross-section.

9. Apparatus as set forth in claim 8, wherein said substantially square apertures have sides of length between about 40 microns and about 160 microns.

10. Apparatus as set forth in claim 9, wherein said apertures have spacings between the centers thereof of between about 50 microns and about 200 microns; the ratio of said side length to said spacing being from about 0.4 to about 0.9.

11. Apparatus as set forth in claim 1, wherein said mesh substrate has a thickness between about 3 microns and about 25 microns.

12. Apparatus as set forth in claim 1, wherein said conversion material layer has a thickness between about 50 microns and about 250 microns.

13. Apparatus as set forth in claim 1, wherein said conductive and transparent film has a thickness between about 100 Angstroms and about 5000 Angstroms.

14. Apparatus as set forth in claim 1, wherein said photoconductive layer has a thickness between about 10 microns and about 100 microns.

15. Apparatus as set forth in claim 1, wherein said charges of said first polarity are negative charges.

16. Apparatus as set forth in claim 15, wherein said first means supplies an electrical potential maintaining said first electrode positive with respect to said thin conductive film.

17. Apparatus as set forth in claim 1, wherein said charges of said first polarity are positive charges.

18. Apparatus as set forth in claim 17, wherein said first means supplies an electrical potential maintaining said first electrode negative with respect to said thin conductive film.

19. The apparatus as set forth in claim 1, further comprising means connected between said conductive thin film and said conductive mesh for applying a fringing field within each of said array of apertures for variably controlling the magnitude of the ion current reaching said insulating sheet.

20. Apparatus as set forth in claim 19, wherein said second means supplies an electrical potential maintaining said mesh electrode positive with respect to said thin conductive film.

21. Apparatus as set forth in claim 20, wherein said second means supplies an electrical potential maintaining said mesh electrode negative with respect to said thin conductive film.

22. The apparatus as set forth in claim 20, wherein said second means supplies a potential of variable magnitude.

23. Apparatus as set forth in claim 1, wherein a portion of said thin conductive film extends toward said mesh member along a portion of those surfaces of said quanta converting material layer defining each of said apertures.

24. Apparatus as set forth in claim 23, further including formations of said conductive film material extending along a portion of those surfaces of said quanta converting material layer surface defining said apertures from said mesh toward said thin conductive film.

25. Apparatus as set forth in claim 24, wherein a gap formed between each of said conductive film extensions and an associated one of said conductive film formations is on the order of 50 microns.

* * * * *